US007090367B2

(12) United States Patent
Eversley

(10) Patent No.: US 7,090,367 B2
(45) Date of Patent: Aug. 15, 2006

(54) ROTATING LIGHT FIXTURE AND METHOD OF MAKING SAME

(76) Inventor: Frederick J. Eversley, 29 Mercer St., New York, NY (US) 10013

( * ) Notice: Subject to any disclaimer, the term of this patent is extended or adjusted under 35 U.S.C. 154(b) by 0 days.

(21) Appl. No.: 10/884,753

(22) Filed: Jul. 2, 2004

(65) Prior Publication Data

US 2005/0007761 A1 Jan. 13, 2005

Related U.S. Application Data

(60) Provisional application No. 60/485,039, filed on Jul. 7, 2003.

(51) Int. Cl.
*F21V 21/30* (2006.01)
*F21V 9/16* (2006.01)
*F21S 10/00* (2006.01)

(52) U.S. Cl. ..... 362/35; 362/565; 362/84; 362/405

(58) Field of Classification Search ..... 362/565, 362/84, 96, 250, 287, 269, 270, 320, 391, 362/405, 407, 418, 35, 806, 404; 40/433, 40/432, 614
See application file for complete search history.

(56) References Cited

U.S. PATENT DOCUMENTS

| | | | | | |
|---|---|---|---|---|---|
| 3,368,215 | A | | 2/1968 | Clement | 340/366 |
| 3,431,410 | A | * | 3/1969 | Dolan et al. | 40/433 |
| 3,477,157 | A | | 11/1969 | Paquette | 40/126 |
| 3,610,918 | A | * | 10/1971 | Barlow | 40/432 |
| 3,681,589 | A | | 8/1972 | Roberts | 240/10.1 |
| 4,097,917 | A | * | 6/1978 | McCaslin | 362/565 |
| 4,176,581 | A | | 12/1979 | Stuyvenberg | 84/464 |
| 4,206,495 | A | | 6/1980 | McCaslin | 362/32 |
| 5,028,206 | A | | 7/1991 | Kendregan et al. | 416/5 |
| 5,029,047 | A | | 7/1991 | Kachel | 362/32 |
| 5,057,981 | A | * | 10/1991 | Bowen et al. | 362/219 |
| 5,072,341 | A | | 12/1991 | Huang | 362/96 |
| 5,082,422 | A | | 1/1992 | Wang | 416/5 |
| 5,383,100 | A | * | 1/1995 | Kikos | 362/34 |
| 5,410,460 | A | * | 4/1995 | Liou | 362/250 |
| 5,437,540 | A | | 8/1995 | Blocker et al. | 416/5 |
| 5,609,509 | A | * | 3/1997 | Stamos | 446/219 |
| 5,791,775 | A | | 8/1998 | Douglass, II | 362/806 |
| 5,800,049 | A | | 9/1998 | Todd, Jr. | 362/294 |
| 5,918,967 | A | * | 7/1999 | Land | 362/255 |
| 6,036,331 | A | | 3/2000 | Acquisto | 362/96 |
| 6,367,942 | B1 | | 4/2002 | Bauer | 362/34 |
| 6,494,595 | B1 | | 12/2002 | Lin | 362/250 |
| 6,612,713 | B1 | | 9/2003 | Kuelbs | 362/102 |
| 6,659,626 | B1 | | 12/2003 | Markey et al. | 362/362 |
| 6,811,283 | B1 | * | 11/2004 | Kovacs | 362/249 |
| 2002/0196624 | A1 | * | 12/2002 | Lin | 362/250 |
| 2003/0235049 | A1 | | 12/2003 | Wu | 362/252 |
| 2004/0004828 | A1 | * | 1/2004 | Chernick et al. | 362/35 |

* cited by examiner

*Primary Examiner*—Stephen Husar
*Assistant Examiner*—Peggy A. Neils
(74) *Attorney, Agent, or Firm*—Jeffer, Mangels, Butler & Marmaro LLP

(57) ABSTRACT

A rotating light fixture and method of creating the same is provided. A plurality of members, such as strings and rods, are attached to a rotational device. Each member has a plurality of light sources connected to it. The plurality of members can expand upon rotation to form a canopy shape, or the plurality of members can itself define a canopy shape. Upon rotation, the light fixture has the appearance of a translucent solid shape.

12 Claims, 9 Drawing Sheets

METHOD FOR CREATING LIGHT FIXTURES BY ROTATING STRINGS OF LIGHTS

CENTRIFUGALLY GENERATED CANOPY OF LIGHT SOURCES
FRONT VIEW - LOW ROTATION SPEED

METHOD FOR CREATING LIGHT FIXTURES BY ROTATING STRINGS OF LIGHTS

FIG 1 - CENTRIFUGALLY GENERATED CANOPY OF LIGHT SOURCES
FRONT VIEW - LOW ROTATION SPEED

METHOD FOR CREATING LIGHT FIXTURES BY ROTATING STRINGS OF LIGHTS

FIG 2 - CENTRIFUGALLY GENERATED CANOPY OF LIGHT SOURCES TOP VIEW - LOW ROTATION SPEED

METHOD FOR CREATING LIGHT FIXTURES BY ROTATING STRINGS OF LIGHTS

FIG 3 - CENTRIFUGALLY GENERATED CANOPY OF LIGHT SOURCES FRONT VIEW - HIGH ROTATION SPEED

METHOD FOR CREATING LIGHT FIXTURES BY ROTATING STRINGS OF LIGHTS

FIG 4- CENTIFUGALLY GENERATED CANOPY OF LIGHT SOURCES
TOP VIEW - HIGH REVOLUTION SPEED

METHOD FOR CREATING LIGHT FIXTURES BY ROTATING STRINGS OF LIGHTS

FIG 5 - CENTRIFUGALLY GENERATED CANOPY OF LIGHT SOURCES
FRONT VIEW - WITH RESTRAINING RING

METHOD FOR CREATING LIGHT FIXTURES BY ROTATING STRINGS OF LIGHTS

FIG 6 - CENTRIFUGALLY GENERATED CANOPY OF LIGHT SOURCES TOP VIEW - WITH RESTRAINING RING

FIG. 7 - SHAPED SUPPORT ROD GENERATED CANOPY OF LIGHT SOURCES
FRONT VIEW

METHOD FOR CREATING LIGHT FIXTURES BY ROTATING STRINGS OF LIGHTS

FIG 8 - SHAPED SUPPORT ROD GENERATED CANOPY OF LIGHT SOURCES
TOP VIEW

ROTATING LIGHT FIXTURE AND METHOD OF MAKING SAME

CROSS-REFERENCE TO RELATED APPLICATIONS

This application claims the benefit of U.S. Provisional Application No. 60/485,039, filed on Jul. 7, 2003.

FIELD OF THE INVENTION

The present invention relates generally to light fixtures, and more particularly, to rotatable light fixtures and methods for making the same.

BACKGROUND OF THE INVENTION

It is well understood that rotating a ball attached by a rope to the center of rotation, around a vertical axis of rotation, creates a centrifugal force, which causes the ball to move away from the axis of rotation and travel in a circular path. The angle between the vertical axis of rotation and the connecting rope is a function of the centrifugal force acting on the ball and gravity, and is thus determined by the angular speed of rotation of the ball. The angle between the vertical axis and the rope thus increases as the speed of rotation increases. The rope, rotating around the axis of rotation, describes a rotating shape in space, in which the inscribed angle of the rope and diameter of the circular path traveled by the ball is a function of the length of the rope and the angular speed of rotation.

A need has developed for a light fixture that applies the foregoing principles to light fixtures. This invention employs these same physical phenomena, with the ball and attached rope being replaced by a flexible string or multiples strings of light sources.

SUMMARY OF THE PREFERRED EMBODIMENTS

The present invention is directed to a rotating light fixture and method for making the same. In accordance with a first aspect of the present invention, a rotating light fixture is provided which comprises a rotational device and a plurality of light assemblies. The rotational device preferably comprises a motor, and more preferably is vertically suspended.

Each light assembly has a plurality of light sources connected thereto. The light assemblies each have first ends which are operatively connected to the rotational device. The plurality of light assemblies has a compact state and an expanded state, such that upon rotation of the rotational device, the plurality of assemblies expands to the expanded state. In preferred embodiments, the expanded state defines a canopy shape. In other preferred embodiments, the light assembly comprises a string. In still other preferred embodiments, the light assembly comprises a tube, and the plurality of light sources are preferably disposed within the tube. In yet other preferred embodiments, the light assembly comprises a rigid or flexible rod.

In certain preferred embodiments, the light sources are light emitting diodes, while in other preferred embodiments the light sources are light bulbs. In additional preferred embodiments, the rotational device defines a rotational axis, and the second end of each light assembly defines an angle with the axis, such that when the rotational device rotates, at least one of the angles increases. In still other preferred embodiments, the second ends of the light assemblies are connected to a restraining ring.

In accordance with a second aspect of the present invention, a rotating light fixture is provided which comprises a rotational device defining an axis of rotation and a plurality of members. Each member is connected to a plurality of light sources, and each member has a first end and a second end. The first end of each member is operatively connected to the rotational device. When the rotational device rotates, the second end of at least one of the members moves away from the axis of rotation. In a preferred embodiment, the plurality of members expands to form a canopy shape. In other preferred embodiments, the members comprise strings. In still other preferred embodiments, the members comprise tubes. In yet additional preferred embodiment, the members comprise rigid or flexible rods. In further preferred embodiments, the second ends of the members are connected to a restraining ring.

In accordance with another aspect of the present invention, a rotating illumination fixture is provided. The fixture comprises a rotational device and a plurality of members. Each member has first and second ends and is operatively connected to the rotational device. Each member has a compact state and an expanded state and also has a plurality of light reflectors connected thereto. Upon rotation of the rotating device, the plurality of members expands to an expanded state, which preferably defines a canopy shape.

In accordance with a further aspect of the present invention, a rotating illumination fixture which comprises a rotational device and a plurality of members is provided. Each member has a compact state and an expanded state and also has a plurality of lenses connected thereto. Upon rotation of the rotating device, the plurality of members expands to an expanded state, which preferably defines a canopy shape.

In accordance with yet another aspect of the present invention, a rotating light fixture is provided which comprises a rotational device and a plurality of members. Each member has a plurality of light sources connected to it and the plurality of members defines a canopy shape. The members are preferably rigid or flexible rods. In a preferred embodiment, the members are tubes.

In accordance with another aspect of the present invention, a method of forming a rotating light canopy is provided. The method comprises providing a plurality of light assemblies, each having a plurality of light sources connected thereto. Each light assembly has first and second ends, and the plurality of light assemblies has a compact and expanded state. In accordance with the method, the first end of each light assembly is rotated about an axis, thereby expanding the plurality of lights to its expanded state. In a preferred embodiment, the plurality of light assemblies defines a canopy shape when in its expanded state.

In accordance with still another aspect of the present invention, a method of forming a rotating light canopy is provided which comprises providing a plurality of members. Each member has a plurality of lights connected to it, and the plurality of members has a compact and expanded state. In accordance with the method, the first end of each member is rotated about an axis, thereby expanding the plurality of members to the expanded state. In preferred embodiments, the plurality of members defines a canopy shape when in its expanded state.

In accordance with another aspect of the present invention, a method of forming a rotating illumination fixture is provided. The method comprises providing a plurality of rods, each having a length and an end, directing light from at least a portion of the length of each rod in a direction perpendicular to the rod's length, and rotating the end of each rod about an axis.

In accordance with a further aspect of the present invention, a rotating light fixture is provided which comprises a rotational device and a plurality of rods. Each rod has a first end, a second end, an interior portion, and a rough surface portion. The first end of each rod is operatively connected to the rotational device and the second end of each rod is adapted to reflect light towards the first end. The fixture further comprises at least one light source, adapted to direct light into the interior portion of each rod at the rod's first end.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
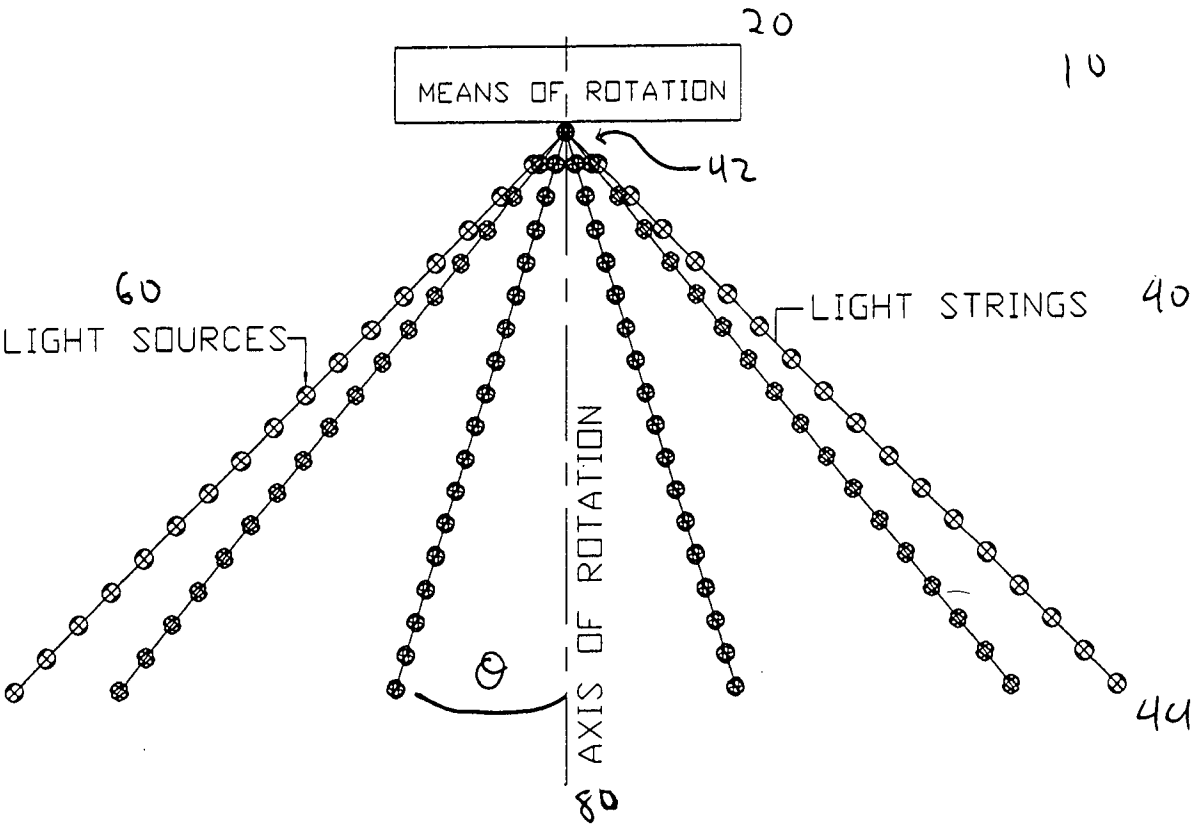
FIG. 1 is a front elevational view of a rotating light fixture in accordance with a preferred embodiment of the present invention, wherein the light fixture is rotating at a relatively low speed of rotation.

Referring to FIG. 1, a rotating light fixture 10 and method of creating the same by rotating one or more flexible strings of lights 40 will now be described. Each string 40 consists of one or more light sources 60, and is rotatable by an axially located rotation means 20. The physical shape of the light fixture 10 is created by either by the centrifugal forces generated on flexible strings 40 or by disposing light sources 60 on shaped light string support elements 100 (see FIG. 7) and rotating support elements 100 around axial axis 80 by external rotation means 20. Each of the flexible strings 40 consists of at least one light source 60 and the connecting wires, which transmit the electrical current to energize the light source. A string of ordinary Christmas tree lights is one simple example of such a flexible string of light sources. Instead of flexible string 40, a common rope light can be used. In a rope light, a series of small lamps or LEDs are encased in a flexible plastic tube and energized from the tube end.

Light sources 60 along the length of string 40 may be wired in series, or in parallel or some combination of series-parallel. A flexible fluoresce or electo-luminesence tube can also be used instead of flexible string 40.

Figure 2:
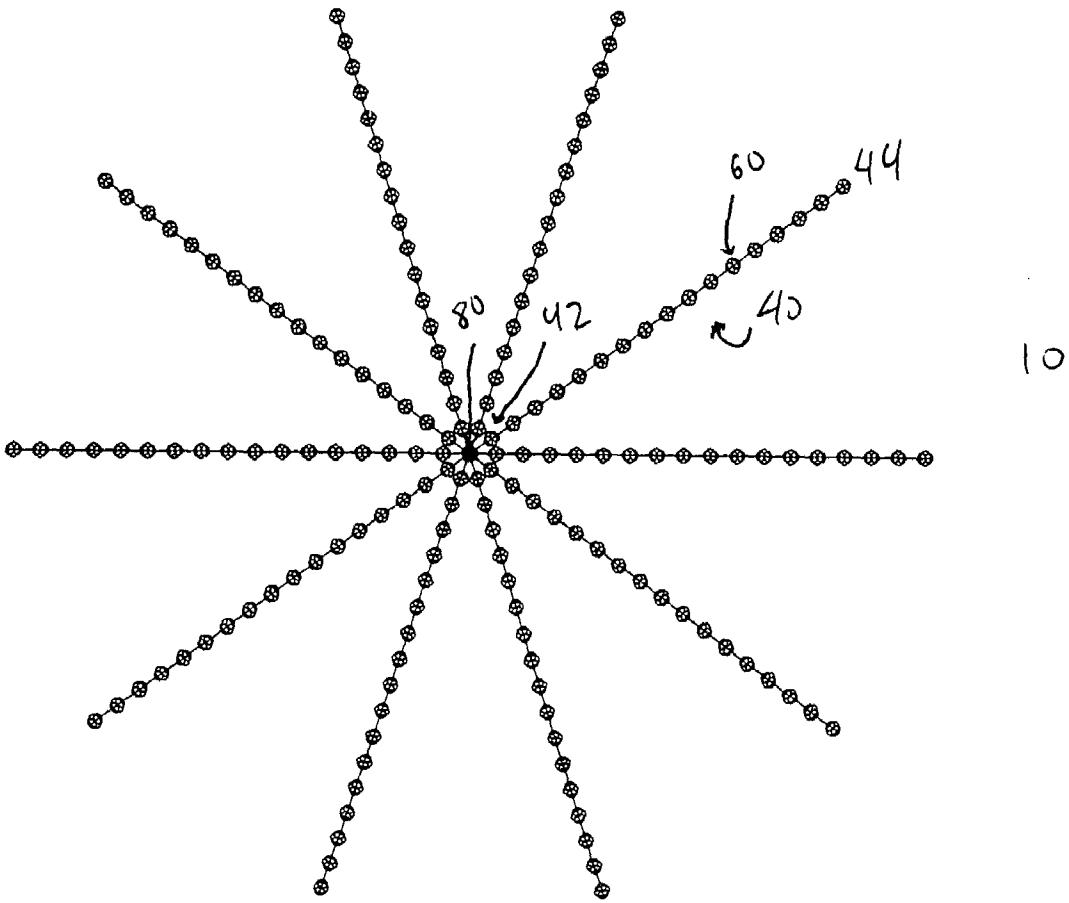
FIG. 2 is a top plan view thereof.
Figure 3:
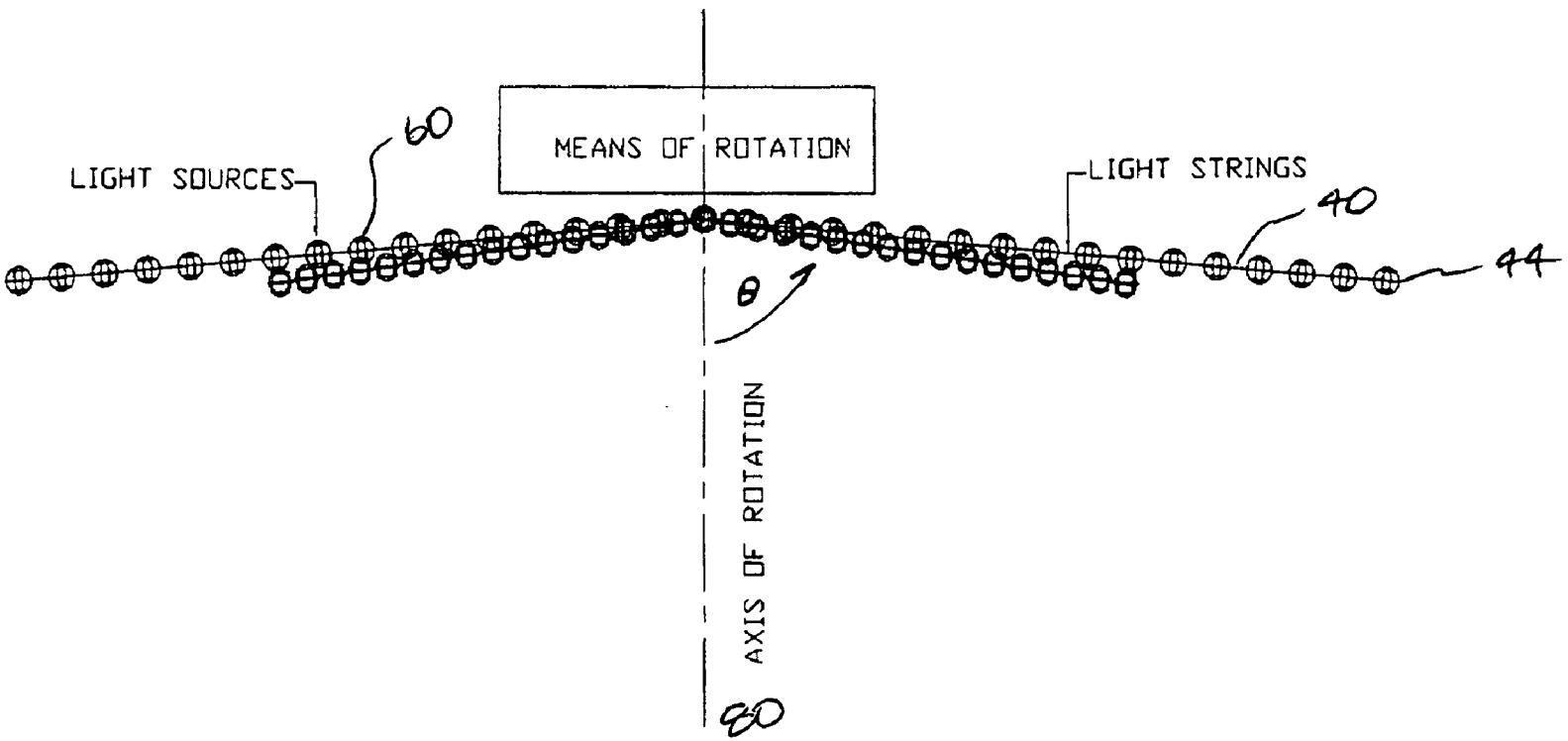
FIG. 3—is a front elevational view thereof at a relatively high speed of rotation
Figure 4:
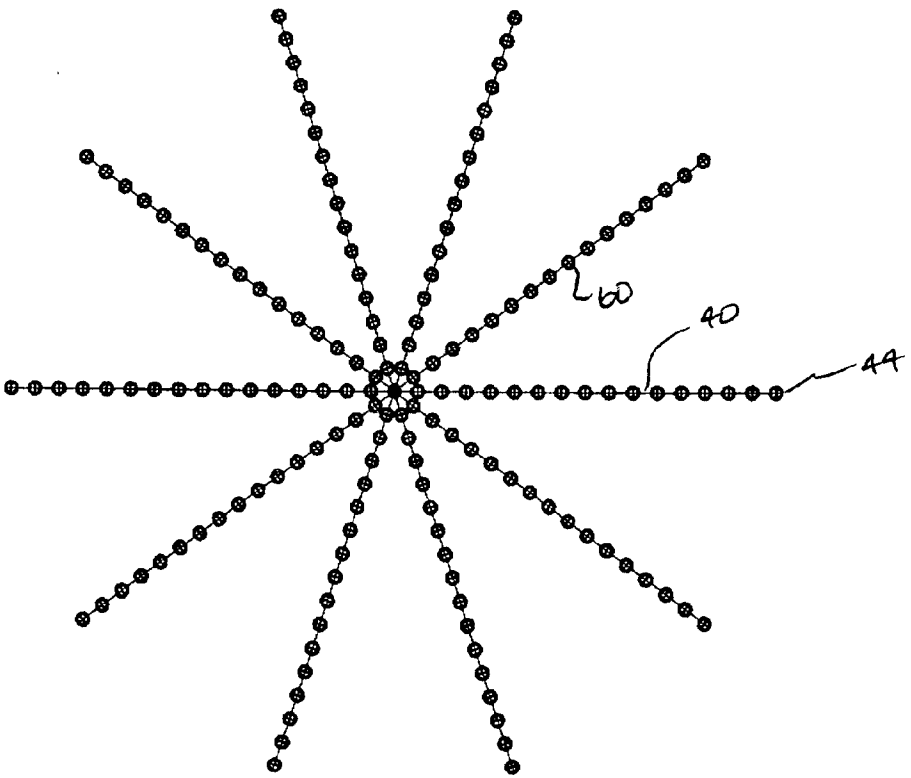
FIG. 4 is a top plan view thereof at a relatively high speed of rotation.

Referring again to FIG. 1, means of rotation 20, which may be a motor, is suspended from the ceiling or attached to a mounting base. At least one end 42 of each string 40 is physically connected to means of rotation 20, which is located at the axis of rotation 80. The remaining length of each of the flexible string or strings 40 of light sources 60 hangs freely down (vertically), while at rest, from the attached end or ends 42. When the means of rotation 20 is energized and starts to rotate, it causes the free hanging portions 44 of the flexible string or strings 40 of light sources 60 to move away from the vertical and form a shape approximating an inverted V, the bottom (free) edge 44 of which travels in horizontal circular path, as best seen in FIGS. 1 & 2. As the speed of rotation increases, the angle e between the rotating flexible string or strings 40 and the vertical axis of rotation 80 increases, and the bottom (free) edge of the string or strings 44 describes a larger circular path, as best seen in FIGS. 3 & 4. When the speed of rotation is fast enough, the angle θ between the flexible string or strings 40 of light sources 60 and the vertical 80 approaches 90 degrees. At this speed, the flexible string or strings 40 of light sources 44 are essentially rotating horizontally and the radius of the described circular path is equal to the free length of the rotating string or strings 40 of light sources 60. The axis of rotation 80, as shown in the attached drawings is vertical, but this invention describes a method of creating a light fixture by rotation in which the axis of rotation can be any angle from vertical to horizontal.

This describes the fundamental basis of this invention: a light fixture whose physical shape of the light fixture is created by rotating unrestrained light string or strings, around an axis, by a means of rotation; and whose overall illuminated visual appearance, with a plurality of lights sources located on the light strings, appears to be a translucent solid shape floating in space, due to persistence of the human eye.

Figure 5:
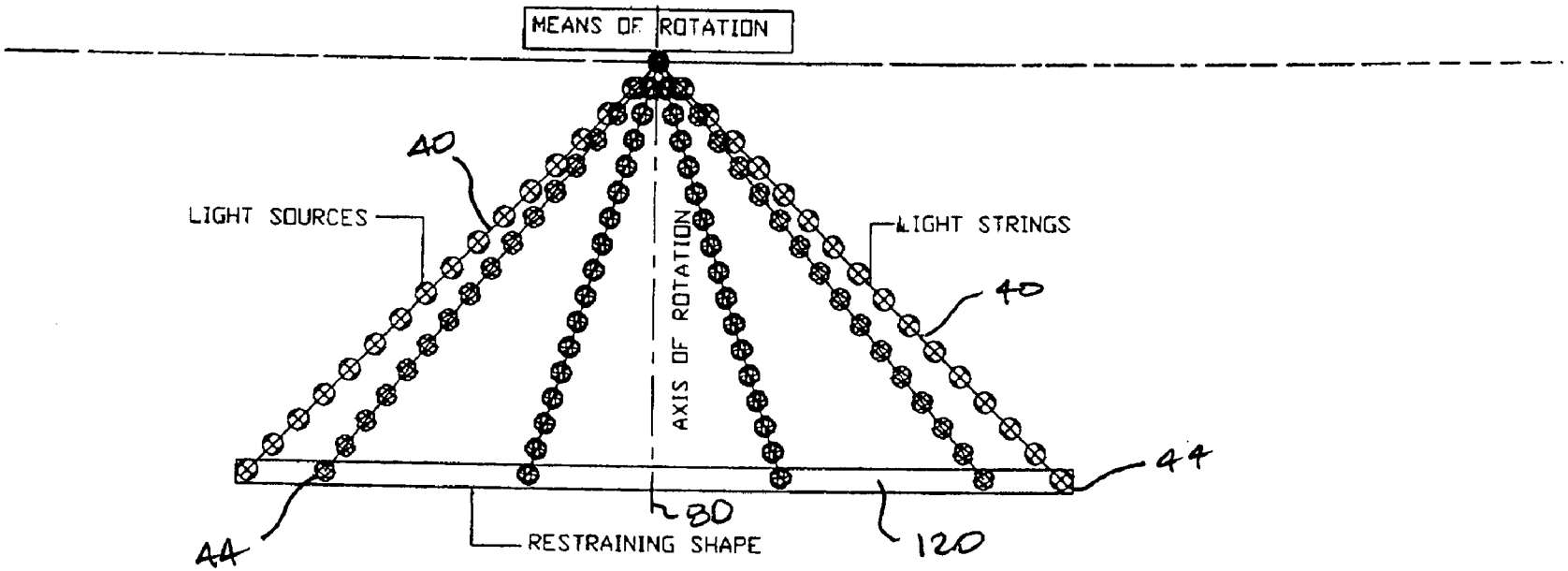
FIG. 5 is a front elevational view of a rotating light fixture in accordance with a preferred embodiment of the present invention.
Figure 6:
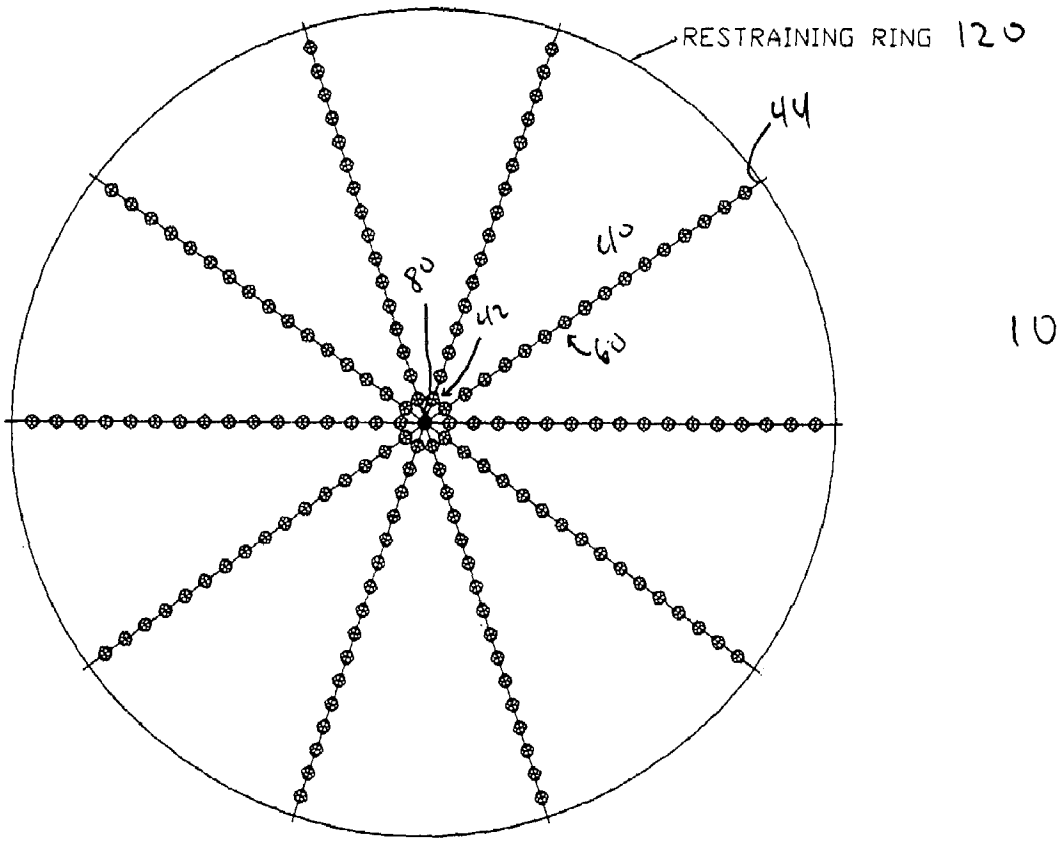
FIG. 6 is a top plan view thereof.

Referring to FIGS. 5 and 6, a second preferred embodiment of the present invention is provided. According to this embodiment, the free end or edge 44 of the flexible light strings 40 may be attached to a circular ring 120 or other shaped ring to restrain the ends to a fixed horizontal displacement from the axis of revolution 80. As the speed of revolution increases the centrifugal forces acting on the light strings 40 will cause the restraining circular ring 120 or other shape to rise vertically, thus creating a different shape then that that would be formed by unrestrained light strings. The location of connection of the flexible light strings 40 to the restraining ring 120 may be such as to cause the light strings 40 to cross each other, thus causing a different rotating canopy shape.

Figure 7:
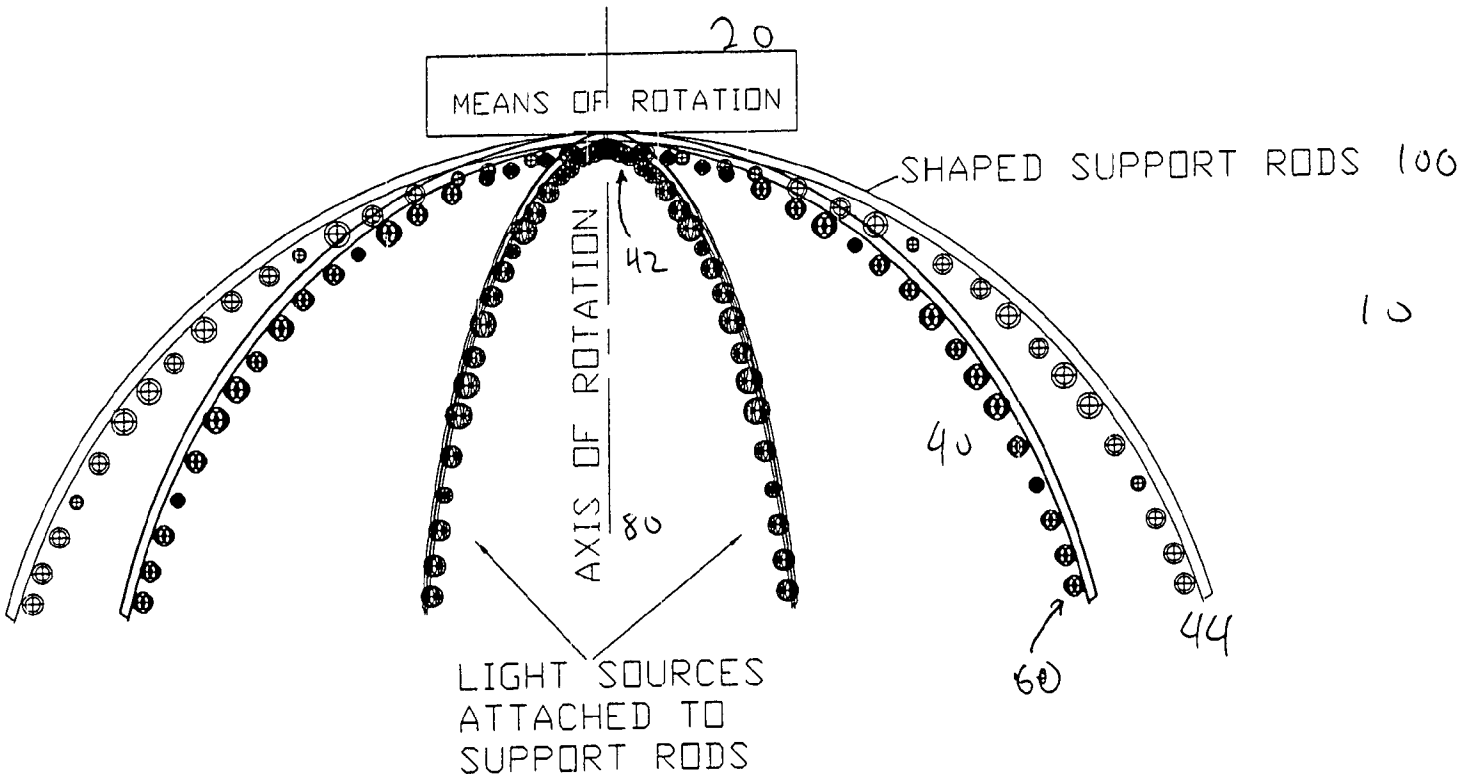
FIG. 7 is a front view of a rotating light fixture in accordance with a preferred embodiment of the present invention.
Figure 8:
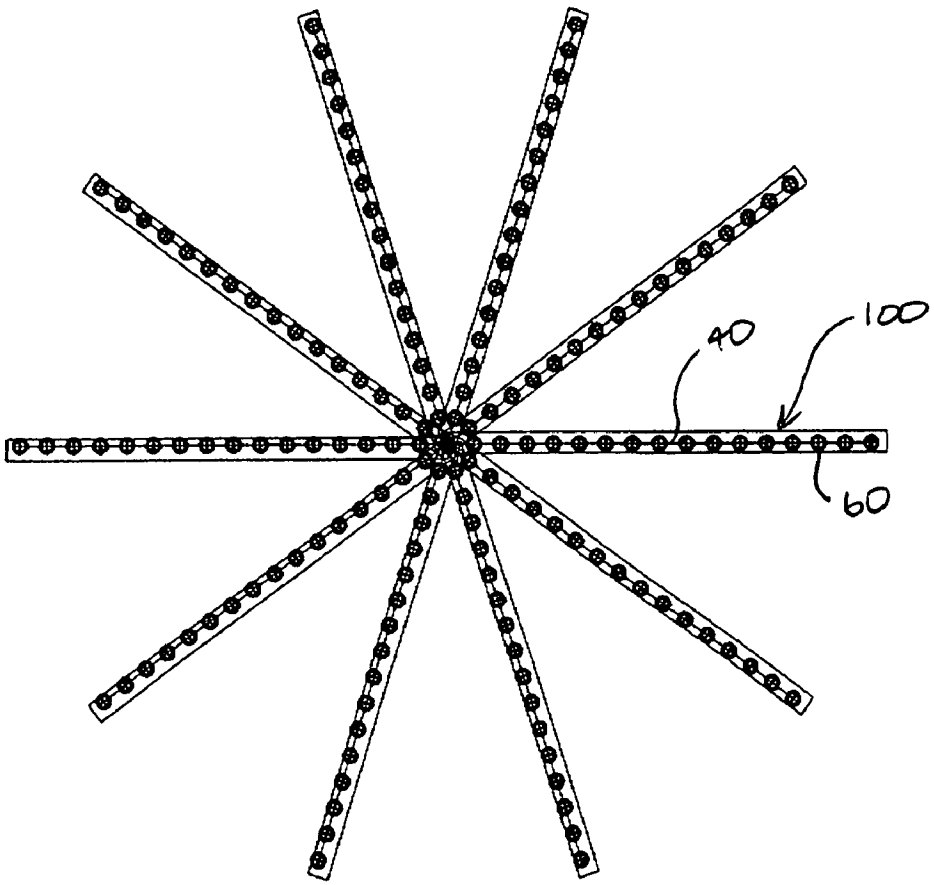
FIG. 8 is a top view thereof.

FIGS. 7 and 8 describe a third preferred embodiment of the present invention. According to this embodiment, the physical shape of a light fixtures is created by a plurality of flexible rods 100 or other flexible shapes which support flexible string or multiple strings of light sources. The flexible rods 100 are rotated around an axial axis 80 by an external rotation means 20, as shown in FIGS. 7 and 8. The overall physical shape of the light fixture is a circular canopy created by the plurality of the rotating light string or strings 40, each of which is shaped by the centrifugal forces acting upon both the light strings 40 and the flexible supporting rods 100 or other flexible shapes.

Referring again to FIGS. 7 and 8, flexible rods 100 can optionally be rigid shaped rods or other rigid shapes, rigidly attached to the means of rotation 20, which support flexible string or multiple strings 40 of light sources 60, rotated around axial axis 80 by external rotation means 20. The rigid rod 100 or other fixed shape may also be attached to means of rotation 20 by hinges (not shown). Centrifugal forces acting on the hinged rigid rods 100 or other rigid shapes and the attached light strings 40 cause them to move away from axis of rotation 80, thus creating a shape in space. The overall illuminated visual appearance of the light fixture 10 is a combination of the rigid canopy shape supporting the light string or strings 40 and the plurality of lights 60 located on each of the light string or strings 40. The overall illuminated visual appearance of the rotating canopy, with a plurality of lights sources 60 located on the light strings 40, appears to be a translucent solid shape floating in space, due to persistence of the human eye.

In the foregoing embodiments, the light sources 60 on each of the flexible strings 40 are energized by an energy source located on the light strings 40 (i.e.—battery), or from an external source; through the means of rotation; by use of slip rings; etc; or by inductive coupling. The light sources 40 may be of any type including incandescent, LED, fluorescent etc. The string may contain one or more wires for excitation of the light sources. The strings 40 may be encased in a flexible tube or other container (i.e.—a light rope); suspended from flexible support wires or ropes, suspended from a rigid or flexible rods 100 which are hinged at or near axis of rotation 80, or simply be the light sources 60 connected by their excitation wires. The light string or strings 40 may have weights placed at their free ends 44 or other locations along their length to alter the canopy shape by altering the centrifugal forces along the length of the string 40.

Many different types of light sources 60 can be used without departing from the spirit and scope of the invention, and the invention is not to be limited to any particular light source. For example, light sources 60 can be either all the same color, or they may be varying colors. The light sources 60 may be continuously illuminated at a constant or variable brightness, or individual light sources may be switched on and off either randomly or by a program to create special visual effects.

The rotation speed, of the means of rotation 20, may be variable to dynamically change the shape of the light fixture 10 by change in rotation speed. The direction of rotation, of the means of rotation, may be reversible, to dynamically change the shape of the light fixture by direction of rotation reversal.

In accordance with a fourth embodiment of the present invention, light sources 60, may be replaced with reflectors, which reflect external light sources. The overall illuminated visual appearance of light fixture 10 is a combination of the shape supporting the reflectors and the plurality of reflectors located on the shape. The overall illuminated visual appearance of the rotating canopy, with a plurality of reflectors, appears to be a translucent solid shape floating in space, due to persistence of the human eye.

In accordance with a fifth embodiment of the present invention, light sources 60, may be replaced with small lenses, which image external light sources and the surrounding environment. The overall illuminated visual appearance of the light fixture is a combination of the shape supporting the lenses and the plurality of lenses located on the shape. The overall illuminated visual appearance of the rotating canopy, with a plurality lenses, appears to be a translucent solid shape floating in space, due to persistence of the human eye.

Figure 9:
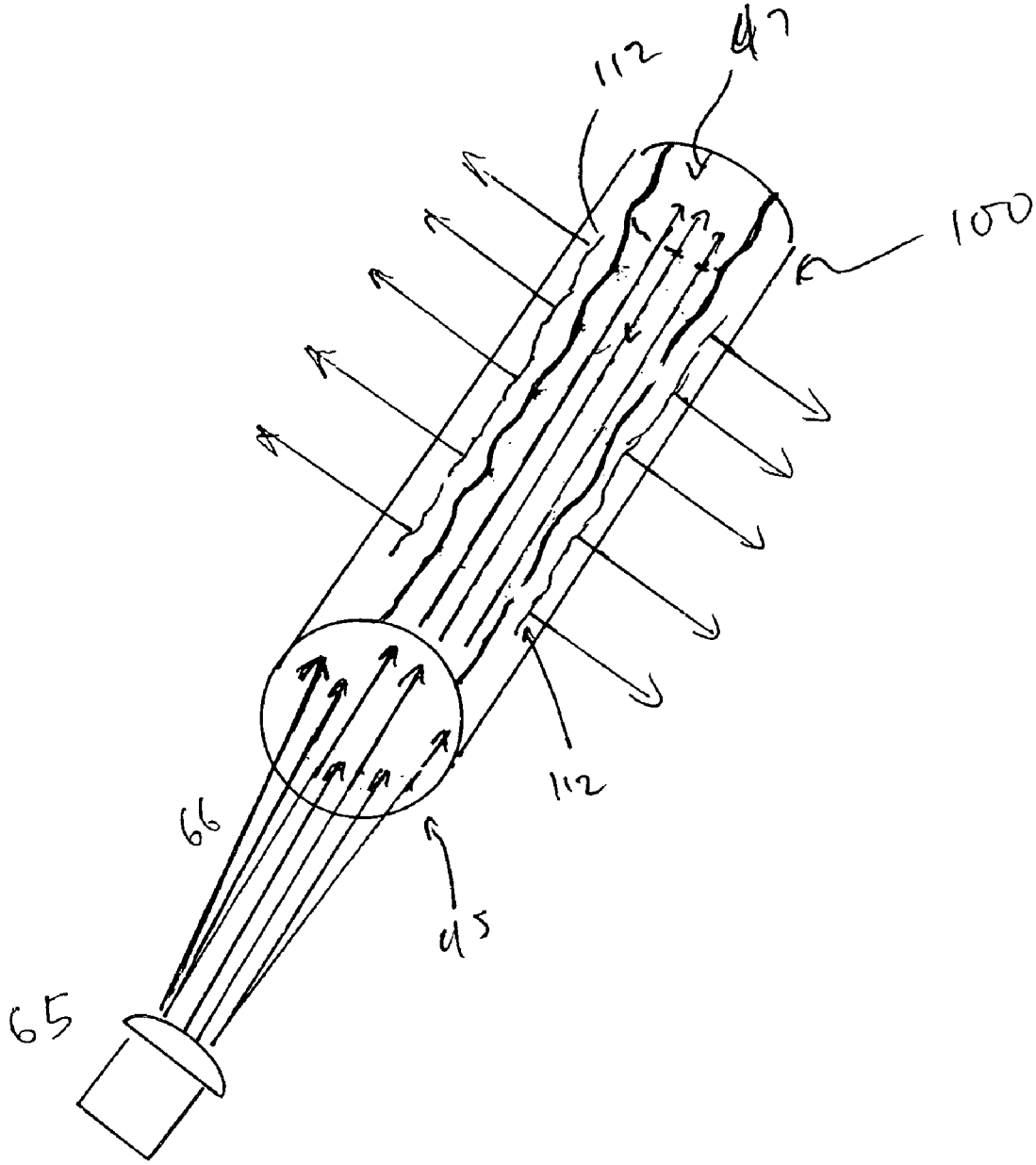
FIG. 9 is a cut away view of an illuminated rod in accordance with a preferred embodiment of a rotating light fixture of the present invention.

In accordance with a sixth embodiment of the present invention, light strings 40, may be replaced with a plurality of plastic rods, or similar materials, each of which are illuminated along their lengths by external light sources. Referring to FIG. 9, a cut-away view of a rod 100 used to form a rotating light fixture is provided. Rods 100, which may be flexible or rigid, are physically attached at a first end 45 to the means of rotation 20 (not shown in FIG. 9) and are rotatable about axis of rotation 80 (not shown in FIG. 9). Rods 100 have a rough inner and/or outer surface portion 112, which can be created by known processes such as sanding, chemical etching, or applying coatings. Light source 65 directs light into the interior of each rod, preferably at first end 45. The opposite end 47 of each rod 100 is adapted to reflect light back towards the first end using a known reflective device such as a film or cap with a known reflective coating. As a result, light directed into the rods 66 is directed radially outward along their respective lengths. The overall physical shape of the light fixture is a combination of the shape of the rods 100, their method of attachment to the means of rotation 20, and the centrifugal forces generated on the rods 100 by the rotation. The overall illuminated visual appearance of the rotating canopy, created by a plurality of edge illuminated plastic rods, appears to be a translucent solid shape floating in space, due to the persistence of the human eye.

The embodiments described above are exemplary embodiments of a the present invention. Those skilled in the art may now make numerous uses of, and departures from, the above-described embodiments without departing from the inventive concepts disclosed herein. Accordingly, the present invention is to be defined solely by the scope of the following claims.

What is claimed is:

1. A rotating light fixture, comprising:

a. a rotational device;

b. a plurality of light assemblies, each said light assembly having a first end and a second end, each said first end begin operatively connected to said rotational device, each said light assembly having a plurality of light sources connected thereto;

wherein said plurality of light assemblies has a compact state and an expanded state, such that upon rotation of said rotational device, said plurality of light assemblies expands to said expanded state; and wherein the light assemblies comprise fluorescent tubes.

2. A rotating light fixture, comprising:

a. a rotational device;

b. a plurality of light assemblies, each said light assembly having a first end and a second end, each said first end being operatively connected to said rotational device, each said light assembly having a plurality of light sources connected thereto;

wherein said plurality of light assemblies has a compact state and an expanded state, such that upon rotation of said rotational device, said plurality of light assemblies expands to said expanded state; and wherein said light assemblies comprise electro-luminescence tubes.

3. A rotating light fixture, comprising:

a. a rotational device;

b. a plurality of light assemblies, each said light assembly having a first end and a second end, each said first end being operatively connected to said rotational device, each said light assembly having a plurality of light sources connected thereto;

wherein said plurality of light assemblies has a compact state and an expanded state, such that upon rotation of said rotational device, said plurality of light assemblies expands to said expanded state; and wherein said light assemblies comprise rods.

4. The rotating light fixture of claim 3, wherein said rods are rigid.

5. The rotating light fixture of claim 3, wherein said rods are flexible.

6. The rotating light fixture of claim 3, wherein said first ends of said rods are hingedly connected to said rotational device.

7. A rotating light fixture, comprising:

a. a rotational device defining an axis of rotation;

b. a plurality of members, each said member having first and second ends, each said first end being operatively connected to said rotational device, and wherein each said member is connected to a plurality of light sources;

wherein when said rotational device rotates, said second end of at least one of said members moves away from said axis of rotation; and wherein said members comprise fluorescent tubes.

8. A rotating light fixture, comprising:

a. a rotational device defining an axis of rotation;

b. a plurality of members, each said member having first and second ends, each said first end being operatively connected to said rotational device, and wherein each said member is connected to a plurality of light sources;

wherein when said rotational device rotates, said second end of at least one of said members moves away from said axis of rotation; and wherein said members comprise electro-luminescence tubes.

9. A rotating light fixture, comprising:

a. a rotational device defining an axis of rotation;

b. a plurality of members, each said member having first and second ends, each said first end being operatively connected to said rotational device, and wherein each said member is connected to a plurality of light sources;

wherein when said rotational device rotates, said second end of at least one of said members moves away from said axis of rotation; and wherein said members comprise rods.

10. The rotating light fixture of claim 9, wherein said rods are rigid.

11. The rotating light fixture of claim 9, wherein said rods are flexible.

12. The rotating light fixture of claim 9, wherein said first ends of said rods are hingedly connected to said rotational device.

* * * * *